US007425974B2

(12) United States Patent
Ogawa

(10) Patent No.: US 7,425,974 B2
(45) Date of Patent: Sep. 16, 2008

(54) CONSUMABLE CASSETTE AND RECORDING APPARATUS

(75) Inventor: Toshihiro Ogawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 53 days.

(21) Appl. No.: 11/673,211

(22) Filed: Feb. 9, 2007

(65) Prior Publication Data

US 2007/0195148 A1 Aug. 23, 2007

(30) Foreign Application Priority Data

Feb. 17, 2006 (JP) ..... 2006-040626
Jan. 24, 2007 (JP) ..... 2007-013396

(51) Int. Cl.
*B41J 17/32* (2006.01)

(52) U.S. Cl. ..... 347/214; 400/208; 400/208.1

(58) Field of Classification Search ..... 347/214; 400/207, 208, 208.1
See application file for complete search history.

(56) References Cited

U.S. PATENT DOCUMENTS 4,869,606 A * 9/1989 Lehmann et al. ..... 400/208
5,216,441 A * 6/1993 Isobe ..... 347/214
5,277,502 A * 1/1994 Kim ..... 400/196
6,522,349 B1 * 2/2003 Lee ..... 347/214
2007/0195155 A1 8/2007 Ogawa

FOREIGN PATENT DOCUMENTS

| | | |
|---|---|---|
| JP | 62-087368 | 4/1987 |
| JP | 62-151370 | 7/1987 |
| JP | 4-065270 | 3/1992 |

* cited by examiner

*Primary Examiner*—Huan H Tran
(74) *Attorney, Agent, or Firm*—Fitzpatrick, Cella, Harper & Scinto

(57) ABSTRACT

In a consumable cassette detachably attached to a recording apparatus and containing a recording material and an ink sheet, a recording material storage section is constantly partially connected to an ink sheet storage section so as to be relatively displaceable in a direction in which the sections disunite from or unite with each other. The sections disunite from each other when the cassette is attached to the recording apparatus, and the sections unite with each other when the cassette is removed from the recording apparatus.

14 Claims, 8 Drawing Sheets

CONSUMABLE CASSETTE AND RECORDING APPARATUS

BACKGROUND OF THE INVENTION

1. Field of the Invention

The present invention relates to a consumable cassette configured to store a recording material and an ink sheet, and a recording apparatus including a recording mechanism to which a consumable cassette is attached and which records an image on a recording material. The present invention more particularly relates to a consumable cassette including a mechanism which is attached to a recording apparatus so as to operate and constitute a space portion where a recording mechanism is combined, and a recording apparatus including an attaching portion to which a consumable cassette is detachably attached.

2. Description of the Related Art

A recording apparatus has functions of a printer, a photocopier and a facsimile machine, and is configured to allow a recording head as a recording unit to record an image (including characters and symbols) on a recording material such as a recording sheet based on image information. As the recording material, various sheet materials are used such as paper, cloth, a plastic sheet and a sheet for OHP. There are recording apparatuses including recording systems of a serial type and a linear type. In the serial type, while main scanning to move the recording head along the recording material is repeated alternately with sheet feeding (sub-scanning) of the recording material, the image is recorded. On the other hand, in the linear type, an elongated recording head extends in a width direction of the recording material. While an image for one line is recorded together by use of the head, the only sheet feeding of the recording material (the sub-scanning) is performed to record the image.

Moreover, the recording apparatus can be classified into recording systems of a thermal transfer type, a heat sensitive type, an ink jet type, a laser beam type and a wire dot type. Among these systems, in the thermal transfer system (a thermal transfer recording apparatus), a recording material is brought into contact under pressure with a recording head via an ink sheet. While the ink sheet is run synchronously with conveyance of the recording material, ink is heated and transferred so as to record the image. There are a sublimation type and a melting type of thermal transfer recording apparatuses. In a recording apparatus to transfer the ink as in the thermal transfer recording apparatus, as consumables, an ink sheet impregnated with the ink and the recording material to which the ink is to be transferred are used. In general, a conventional recording apparatus is adapted to store the ink sheet and the recording material in exclusive-use cassettes, respectively. These cassettes are loaded to the recording apparatus from separate directions, respectively.

For example, Japanese Utility Model Application Laid-Open No. H01-139563 discusses an ink sheet storage section to store an ink sheet. A cassette configuration of the section is proposed in which the ink sheet is stored and which is detachably attached to a recording apparatus. In this example, an opening is disposed in a part of the cassette so as to bring the surface of the ink sheet coated with ink into contact with a recording material. When an ink sheet cassette is handled, dust and fingerprint are sometimes attached to the ink coated surface of the ink sheet via this opening.

On the other hand, in a proposed construction of a recording material storage section to store the recording material, a user opens a package containing the ink sheet cassette and a bundle of recording materials, and takes out the recording material to transfer the material to a cassette for exclusive use prepared separately. Moreover, the exclusive-use cassette containing the recording material is attached to the recording apparatus to constitute the recording material storage section. A recording surface of this type of recording material is generally set so as to improve a fixing property of the ink and achieve high-quality image formation. To record an appropriate image, front and back surfaces of the recording material need to be confirmed, and a recording surface needs to be directed in a predetermined direction and stored in the cassette. Therefore, when the recording material is stored in another cassette for exclusive use, many complicated preparing operations are required. When the material is transferred from the package to the cassette, attention needs to be paid so that fingerprint and dust are not attached to the recording surface. Therefore, it cannot be said that this construction has an excellent handling property.

In the construction in which the recording material is stored in the cassette for exclusive use in this manner, during an operation to store the recording material, dirt (attachment of dust, garbage and fingerprint) and a crack (deformation, breakage) are easily generated on the recording surface of the recording material. The dirt and crack are a cause for deterioration of an image quality of the recorded image.

In addition, in this type of recording apparatus, it is expected that a user arbitrarily selects various finishes such as color photograph print, print for exclusive use in a monochromatic photograph and seal and various sizes (a postcard size, an L-size, a 2L-size, etc.) to perform printing. To execute optimum recording which meets user's expectation, a corresponding type of combination of the ink sheet and the recording material can be used in accordance with the finish. When the printing is not performed based on the optimum combination, the expected finish is not achieved. The image cannot be recorded as expected in accordance with an original performance, or the recording is not easily achieved in some case.

Therefore, when the recording material and the ink sheet are handled by use of the separate cassettes for exclusive use, the user needs to select the ink sheet cassette and the recording material cassette so as to appropriately cope with the recording. However, the user might make a mistake in selecting the appropriate combination.

For example, the ink sheet cassette for exclusive use in the monochromatic photograph is combined with the recording material cassette for exclusive use in the monochromatic photograph in which gradation of the monochromatic photograph can sufficiently be achieved. After the recording is performed with this combination, the ink sheet cassette is replaced with a chromatic ink sheet cassette for a purpose of printing the color photograph, but the user forgets to replace the recording material cassette. In such an assumed case, color development in a printed matter might not be obtained as expected.

In future, the recording in which this type of recording apparatus is utilized is expected to enlarge. There is a possibility of increase of types of usable consumables which meet user's requirements. In such a case, it is necessary to determine an appropriate combination of the recording material cassette and the ink sheet cassette. Alternatively, it is necessary to determine the types of the ink sheet cassette and the recording material cassette attached to the recording apparatus and to notify whether or not the combination is appropriate. Therefore, a situation is caused in which a new determination unit and a new notification unit are required for transmission of information to a printer side.

When the ink sheet cassette and the recording material cassette are independently and individually handled, respectively, problems of storing properties of the cassettes cannot be ignored. That is, when the cassettes are removed from the recording apparatus and stored, one of the ink sheet cassette and the recording material cassette is easily lost. To use a different type of recording material, the recording material which is not used needs to be taken out of the cassette for exclusive use. The user has to prepare a storage member or space for storing this taken recording material.

Several proposals have been made in order to solve a problem and obviate an inconvenience in a case where the cassettes for exclusive use in the ink sheet and the recording material are individually used as described above, respectively.

One of the proposals is that the ink sheet and the recording material be stored in one cassette to handle an integrated consumable cassette. According to this proposal, two types of consumables, that is, the ink sheet and the recording material are stored in one cassette. Two types of consumables can be integrated and loaded to the recording apparatus from one common direction (e.g., a side surface of the recording apparatus). Therefore, a handling property of the consumable cassette can be improved.

As examples of such an integrated construction, Japanese Patent Application Laid-Open Nos. S62-087368 and S62-151370 discuss a consumable cassette in which a recording material storage section and an ink sheet storage section are arranged in a longitudinal direction of a recording material (a direction along a conveyance direction). In consequence, the handing property can be improved. In addition, the cassette can be thinned. Japanese Utility Model Application Laid-Open No. H02-044058 discusses an ink sheet cassette in which a supply side of an ink sheet is disposed close to a wind-up side, thereby realizing miniaturization of the ink sheet storage section.

As another example, Japanese Patent Application Laid-Open No. H04-065270 discusses a cassette structure of a thermal transfer recording apparatus having excellent consumable storing property and space saving property. In this example, when a recording material cassette and an ink sheet cassette are not attached to a printer, the cassettes are stacked. To attach both the cassettes to the printer, the cassettes are opened and arranged in parallel.

However, according to the constructions of the consumable cassettes described in the above publications, when the cassette is loaded to the recording apparatus in a recordable state, the ink sheet storage section is disposed in parallel with the recording material storage section along a supply direction of a recording material conveyance path. The sections are arranged in substantially the same plane.

Therefore, since the recording apparatus includes a conveyance mechanism of the ink sheet, a conveyance mechanism of the recording material and further the recording head, an installation area of the apparatus necessarily enlarges. That is, the maximum installation area of the recording apparatus including the attached consumable cassette for use is not smaller than a size obtained by adding up an arrangement area of the storage section in which the recording material having the maximum size is stored and an arrangement area of the storage section of the ink sheet.

In addition, a factor for the enlargement of the installation area of the apparatus is extension of the apparatus caused by disposing the ink sheet storage section in a direction in which the recording material is conveyed in addition to the recording material storage section as disclosed in, for example, Japanese Patent Application Laid-Open No. H04-065270. In many cases, this portion extended along the supply direction corresponds to a longitudinal direction of the recording material. Therefore, such dimensional inclination of the structure in the longitudinal direction is a factor for destroying a balance between the installation area of the recording apparatus and a height direction of the apparatus.

Moreover, as disclosed in Japanese Patent Application Laid-Open No. H04-065270, there is a peculiar problem in a case where a configuration of the cassette changes. For example, the cassette has different constructions during the storage and during the recording. That is, in this case, every time the cassette is loaded to or removed from the recording apparatus, such an excess operation as to change the configuration of the cassette, for example, an opening/closing operation is required.

The operation is manually or electromotively performed to change the configuration of the cassette to a state of the stored cassette or a state of the cassette during a recording operation.

Especially, as disclosed in Japanese Patent Application Laid-Open No. H04-065270, when the cassette is removed from the recording apparatus, the recording material and the ink sheet are exposed and opened. Therefore, the dirt (the attachment of the dust and fingerprint) and the crack (the deformation, the breakage) are easily generated on the recording material and the ink sheet. When the cassette is attached to the recording apparatus, the ink sheet and the recording material need to be adjusted into appropriate states in a recording position. It is expected that a long time is required until the recording operation is restarted.

SUMMARY OF THE INVENTION

The present invention has been developed in view of the above technical problem.

An object of the present invention is to provide a consumable cassette which can easily be attached to a recording apparatus from one direction in the form of the consumable cassette constituted by integrating a recording material storage section and an ink sheet storage section and which can contribute to miniaturization of the recording apparatus.

Moreover, an object of the present invention is to provide a consumable cassette having excellent storing properties of a recording material and an ink sheet at a time when the cassette is removed from a recording apparatus.

Furthermore, an object of the present invention is to provide a consumable cassette which can quickly and securely be attached to a recording apparatus and which has an excellent handling property.

In addition, an object of the present invention is to provide a recording apparatus including a miniaturized construction in which an operable portion of a consumable cassette can be operated at a time when the consumable cassette is attached or detached.

To achieve the above objects, a consumable cassette of the present invention comprises: a recording material storage section to store a recording material; and an ink sheet storage section to store an ink sheet, the consumable cassette being detachably attached to a recording apparatus, the consumable cassette further comprising: an operation structure to connect the recording material storage section to the ink sheet storage section and to displace the recording material storage section and the ink sheet storage section in a direction in which the sections come away from each other and a direction in which the sections come close to each other.

Moreover, a recording apparatus of the present invention comprises: a loading section to which a consumable cassette is to be loaded, the consumable cassette comprising: a recording material storage section to store a recording material; and an ink sheet storage section to store an ink sheet, the recording apparatus further comprising: a recording mechanism including a recording material conveyance mechanism which operates the recording material storage section, an ink sheet conveyance mechanism which operates the ink sheet storage section and a recording head; and an operation structure to connect the recording material storage section to the ink sheet storage section and to displace the recording material storage section and the ink sheet storage section in a direction in which the sections come away from each other and a direction in which the sections come close to each other.

According to the present invention, the consumable cassette is configured to operate in the direction in which the recording material storage section and the ink sheet storage section come away from each other so as to constitute a space where components constituting the recording apparatus are arranged, when the cassette is attached to the recording apparatus. Therefore, in a non-attached state in which the cassette is removed from the recording apparatus, the cassette has a thin construction and has an excellent handling property. Further in the non-attached state, the recording material storage section and the ink sheet storage section come close to each other. Therefore, rigidity of the consumable cassette can be improved. Moreover, since an access from the outside is limited, dust, garbage and fingerprint can be inhibited from being attached to the ink sheet and the recording material in the non-attached state.

According to the present invention, it is possible to provide the consumable cassette by which the recording material and the ink sheet can easily be loaded to the recording apparatus from one direction and which advantageously contributes to miniaturization of the recording apparatus. The consumable cassette is provided which has excellent storing properties of the recording material and the ink sheet, when the cassette is removed from the recording apparatus. The consumable cassette is provided which can quickly and securely be attached to the recording apparatus and which has an excellent handling property.

Moreover, it is possible to provide the miniaturized recording apparatus including the construction capable of operating the operable portion of the consumable cassette, when the consumable cassette is attached or detached.

Further features of the present invention will become apparent from the following description of exemplary embodiments with reference to the attached drawings.

BRIEF DESCRIPTION OF THE DRAWINGS

FIG. 3A illustrates that the cassette is removed from a recording apparatus, and FIG. 3B is a perspective view from which the recording apparatus is omitted and which illustrates that the cassette is disposed in the recording apparatus.

FIG. 4A illustrates that the cassette is removed from a recording apparatus, and FIG. 4B is a perspective view from which the recording apparatus is omitted and which illustrates that the cassette is disposed in the recording apparatus.

FIG. 5A illustrates that the cassette is removed from a recording apparatus, and FIG. 5B is a perspective view from which the recording apparatus is omitted and which illustrates that the cassette is disposed in the recording apparatus.

FIG. 6A illustrates that the cassette is removed from a recording apparatus, FIG. 6B is a perspective view from which the recording apparatus is omitted and which illustrates that the cassette is disposed in the recording apparatus, and FIG. 6C is a perspective view from which the recording apparatus is omitted and which illustrates a state as viewed from a direction reverse to that of FIG. 6B.

FIG. 7A illustrates that the cassette is removed from a recording apparatus, and FIG. 7B is a perspective view from which the recording apparatus is omitted and which illustrates that the cassette is disposed in the recording apparatus.

FIG. 8A illustrates that the cassette is removed from a recording apparatus, and FIG. 8B is a perspective view from which the recording apparatus is omitted and which illustrates that the cassette is disposed in the recording apparatus.

DESCRIPTION OF THE EMBODIMENTS

Figure 1:
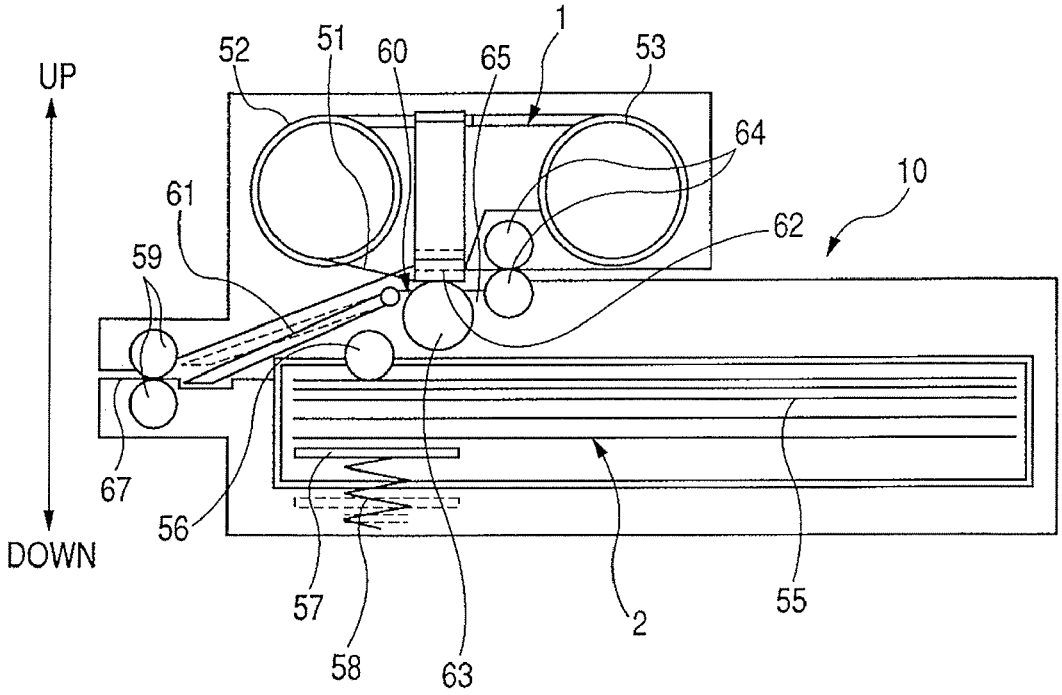
FIG. 1 is a schematic diagram of an exemplary recording apparatus in which a consumable cassette is to be used according to the present invention as viewed from a side surface.
Figure 2:
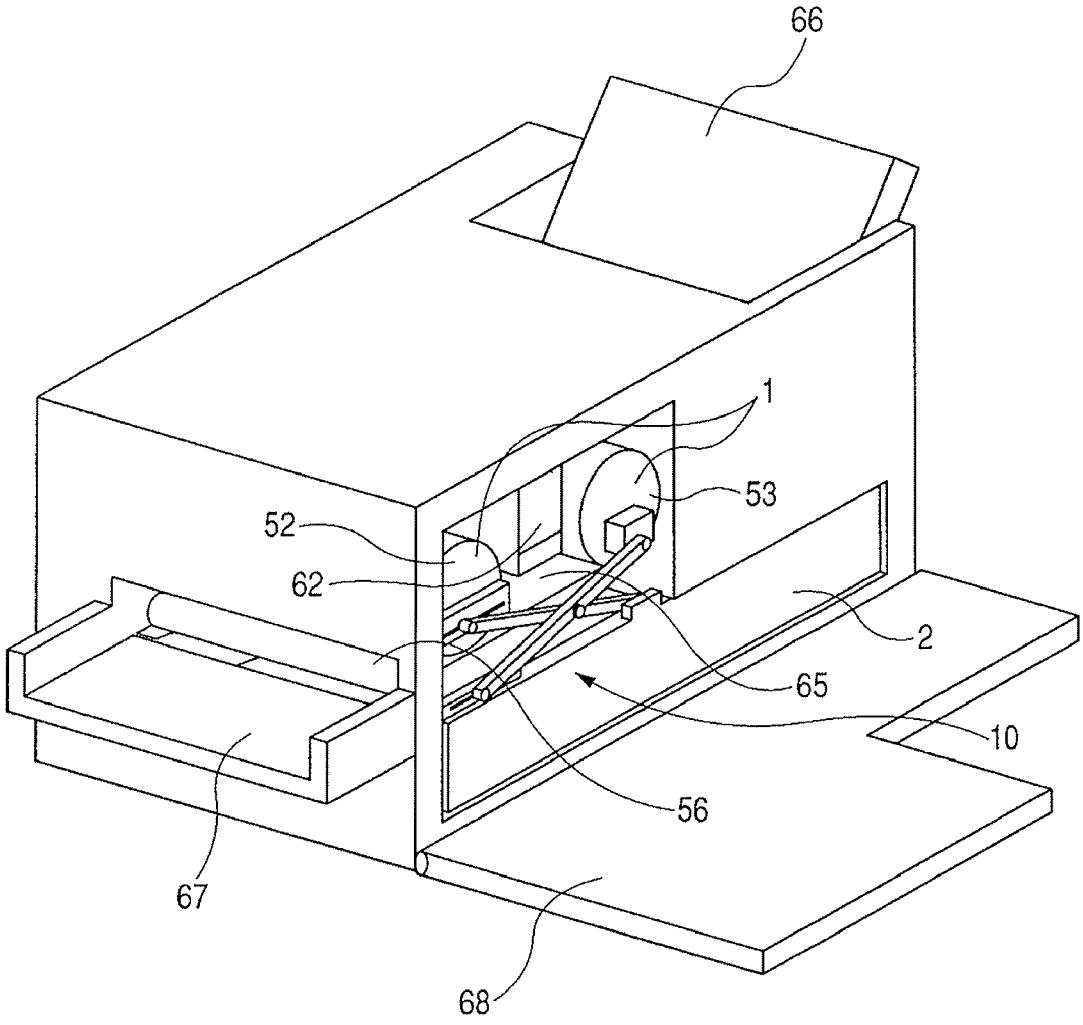
FIG. 2 is a perspective view schematically illustrating an exemplary recording apparatus in which the consumable cassette is to be used according to the present invention.

Embodiments of the present invention will hereinafter be described specifically with reference to the drawings. It is to be noted that in the drawings, the same reference numerals are the same or corresponding components. FIG. 1 is a schematic diagram illustrating a schematic construction of an exemplary recording apparatus in which a consumable cassette is to be used according to the present invention. FIG. 2 is a perspective view illustrating a schematic construction of an exemplary recording apparatus in which the consumable cassette is to be used according to the present invention. In FIGS. 1 and 2, the illustrated recording apparatus drives a heat generation element of a thermal head (a recording head) as a recording unit based on image information. Ink with which an ink sheet is impregnated is melted and transferred to a recording material such as a recording sheet to thereby record an image. An ink sheet 51 is wound around a supply roll of a supply roll storage section 52 and a windup roll of a windup roll storage section 53 in a cassette-like ink sheet storage section 1. A plurality of recording materials 55 are stacked and stored in a recording material storage section 2.

The ink sheet storage section 1 is partially integrally connected to the recording material storage section 2 as described later to constitute a consumable cassette 10. The ink sheet storage section 1 is disposed so as to be superimposed upon a direction in which the recording materials are stacked in the recording material storage section 2, the direction being assumed as a reference direction (assuming that a vertical (up-down) direction shown by an arrow in FIG. 1 is the reference direction, the ink sheet storage section is disposed so as to be stacked on the recording material: the embodiments will be described assuming that a vertical direction of a shown state meets the vertical direction shown by the arrow of FIG. 1 unless otherwise mentioned). In an upper part of a recording material sending section of the recording material storage section 2, a supply roller (a pickup roller) 56 is disposed which separately sends out the recording material sheet by sheet. Under the recording material storage section 2, a pressure plate 57 and a pressure leaf spring 58 are arranged so as to bring the stacked recording materials 55 into contact under pressure with the supply roller 56. The recording material 55 sent out by the supply roller 56 is sandwiched between a pair of first conveyance rollers 59 arranged in a conveyance path 67. The material is then conveyed to an image recording section 60 along a guide member 61 by the pair of first conveyance rollers 59.

The guide member 61 is formed of a plate-like member disposed in a switchable position. The member forms a conveyance path leading to the image recording section 60 in a position shown by a solid line, and forms a conveyance path leading from the supply roller 56 to the pair of first conveyance rollers 59 in a position shown by a chain line. That is, in the present embodiment, a rotation driving direction of the pair of first conveyance rollers 59 is controlled so as to convey the recording material 55 from the recording material storage section 2 to the image recording section 60 by switchback conveyance. The image recording section 60 includes a recording head 62 and a platen roller 63. On a downstream side of a conveyance direction of the platen roller 63, a pair of second conveyance rollers 64 are arranged.

The recording material 55 having the image recorded thereon by the image recording section 60 is discharged onto a discharge tray 66 (FIG. 2) disposed in a rear upper part of a recording apparatus main body by the pair of second conveyance rollers 64. Therefore, the conveyance path of the recording material 55 is the recording material storage section 2→a conveyance path 67→the guide member 61→the image recording section 60→the discharge tray 66. The recording material 55 is reciprocated between the conveyance path 67 and the discharge tray 66 to enable color image recording so that colors are superimposed upon one another. To perform the recording, a space 65 is disposed between the recording material storage section 2 and the ink sheet storage section 1 in the consumable cassette 10. This space 65 contains a part of components constituting the recording apparatus such as the supply roller 56, the recording head 62, the platen roller 63 and the pair of second conveyance rollers 64.

In FIG. 2, an openable and closeable cover (or a side plate) 68 is attached to one side surface of the recording apparatus. When the cover 68 is opened, the consumable cassette 10 can be disposed in the recording apparatus, or taken out of the recording apparatus. That is, the integrated consumable cassette 10 containing the ink sheet 51 and the recording material 55 is detachably attached to the one side surface of the recording apparatus.

FIGS. 3A to 8B illustrate exemplary embodiments of the integrated consumable cassette to which the present invention is applied and in which the ink sheet and the recording material are stored. According to the following embodiments, the consumable cassette can roughly be classified into three groups as follows.

That is, a first group has a construction in which a recording material storage section is connected to an ink sheet storage section via a rotatably attached rotary member. When the rotary member rotates, both of the storage sections are disunited from or united with each other. Such a construction is shown in a first embodiment of FIGS. 3A and 3B and a second embodiment of FIGS. 4A and 4B.

A second group has a construction in which a recording material storage section is connected to an ink sheet storage section via a slide member. When a consumable cassette is detached from or attached to a recording apparatus, the slide member is slidable so as to be partially engaged with the recording apparatus and then slid. When the slide member moves, both of the storage sections are disunited from or united with each other. Such a construction is shown in a third embodiment of FIGS. 5A and 5B and a fourth embodiment of FIGS. 6A, 6B and 6C.

A third group has a construction in which a recording material storage section is connected to an ink sheet storage section via an expandable/contractible member or an elastically displaceable member. Both of the storage sections are disunited from or united with each other utilizing elasticity of the expandable/contractible member or the elastic member. Such a construction is shown in a fifth embodiment of FIGS. 7A and 7B and a sixth embodiment of FIGS. 8A and 8B.

The embodiments of the consumable cassette according to the present invention will hereinafter be described in order.

First Embodiment

Figure 3A:
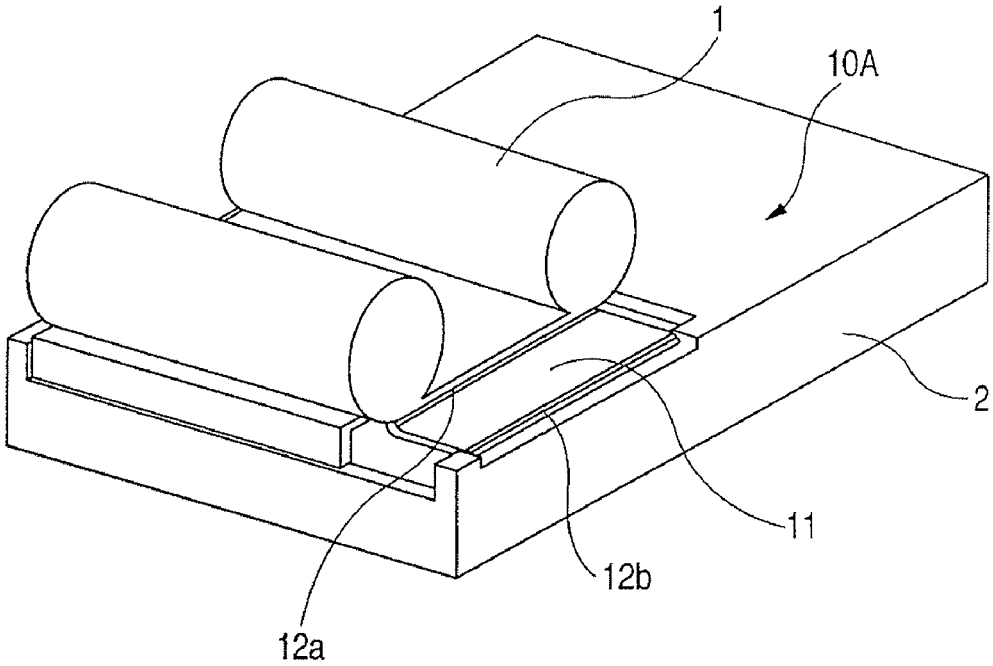
FIGS. 3A and 3B are perspective views schematically illustrating a first embodiment of the consumable cassette according to the present invention.
Figure 3B:
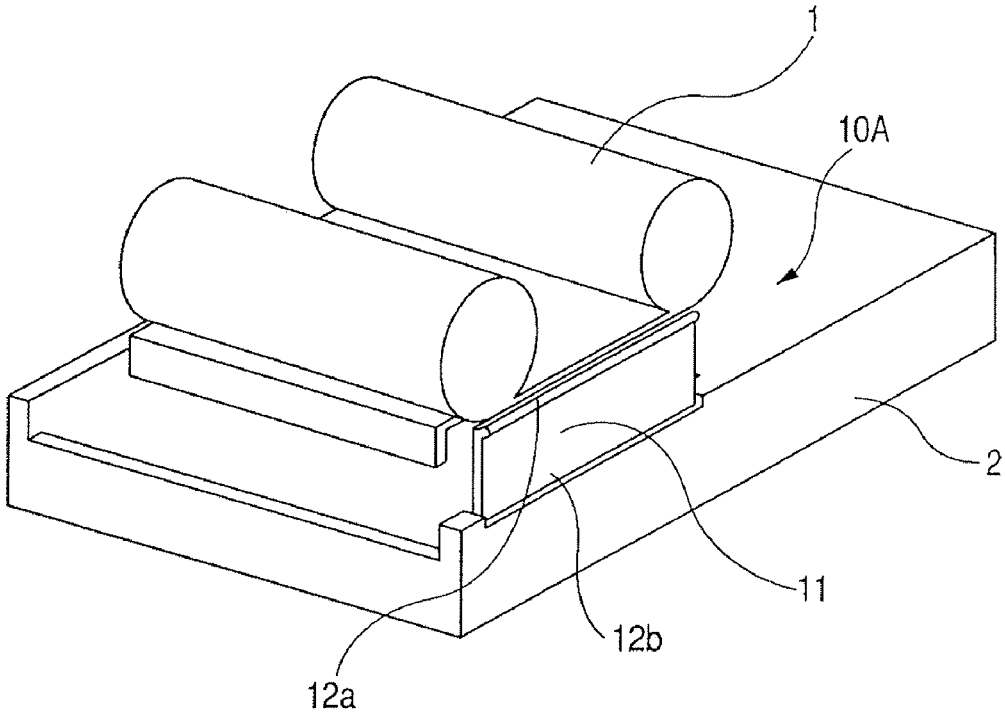

FIGS. 3A and 3B are perspective views of the first embodiment of a consumable cassette according to the present invention, FIG. 3A illustrates that the cassette is removed from a recording apparatus, and FIG. 3B illustrates that the cassette is disposed in the recording apparatus, the recording apparatus being omitted. In FIGS. 3A and 3B, a consumable cassette 10A is integrally constituted so that an ink sheet storage section 1 is connected to a recording material storage section 2 via a rotary member 11. The ink sheet storage section 1 is stacked on the recording material storage section 2. That is, a rotary shaft portion 12*a* is disposed at one side end portion of the ink sheet storage section 1, and a rotary shaft portion 12*b* is disposed at one side end portion of the recording material storage section 2. Both of the rotary shaft portions 12*a*, 12*b* are connected to opposite end portions of the rotary member 11.

It is to be noted that in the ink sheet storage section 1, an ink sheet 51 wound around a supply roll and a windup roll is stored. In the recording material storage section 2, a recording material 55 such as a recording sheet is stored. Ink is thermally transferred from the ink sheet to the recording material by a recording head (a thermal head) 62 to record an image.

The rotary member 11 constituting the consumable cassette 10A connects the side end portion of the ink sheet storage section 1 to the side end portion of the recording material storage section 2 via the rotary shaft portions 12*a*, 12*b* crossing an attaching/detaching direction of the consumable cassette. This rotary member 11 can move the cassette between a united position shown in FIG. 3A and a disunited position shown in FIG. 3B. Each of the two rotary shaft portions 12*a*, 12*b* is deformable in an angle range of 0 degree to 90 degrees.

In the present embodiment, when the consumable cassette 10A is attached to the recording apparatus, a guide portion (not shown) in the recording apparatus brings the cassette into the disunited state shown in FIG. 3B. In this disunited state, a space 65 is secured between the ink sheet storage section and the recording material storage section so as to store constituent components such as a supply roller 56 and a platen roller 63 of the recording apparatus. At least one of the two rotary shaft portions is provided with an elastic member such as a torsion spring which urges the rotary member 11 in a united state. On removing the consumable cassette 10A from the recording apparatus, the cassette can be changed from the disunited state of FIG. 3B to the united state of FIG. 3A by this elastic member.

Therefore, it is possible to improve a handling property of the consumable cassette at a time when the recording material and the ink sheet are loaded to or removed from the recording apparatus from one direction. When the consumable cassette is removed, the cassette is thinned. Therefore, space saving can be achieved. It is possible to facilitate management and improve a storing property of the consumable cassette 10A at a time when the cassette is removed from the recording apparatus and stored. In a state in which the cassette is removed, the recording material storage section and the ink sheet storage section come close to each other, and are stacked. Since it is difficult to access the storage sections from the outside, dirt and crack are not easily generated on the recording material and the ink sheet. The consumable cassette having an excellent consumable storing property is provided in this manner. Furthermore, the consumable cassette is provided which advantageously miniaturizes the recording apparatus while keeping a satisfactory balance between an installation area and a height direction. In addition, the consumable cassette having an excellent handling property is provided. Therefore, the cassette can quickly and securely be attached to or detached from the recording apparatus by one operation.

Here, exemplary features implemented in the above first embodiment and the following embodiments will be described. In any of the embodiments, the consumable cassette 10 is attached to or detached from the recording apparatus from a direction crossing a recording material conveyance direction of the apparatus (from a side surface of the recording apparatus). Moreover, in at least one embodiment, the ink sheet storage section 1 is urged in such a direction as to unite with the recording material storage section 2. In consequence, the consumable cassette shifts to a united state, when the cassette is detached from the recording apparatus, and shifts to a disunited state against an urging force, when the cassette is attached to the recording apparatus. When the cassette is detached from the recording apparatus, the ink sheet storage section 1 regulates movement of the recording material 55 of the recording material storage section 2. Moreover, the recording material storage section is configured to protect the ink sheet 51 of the ink sheet storage section.

Furthermore, when the consumable cassette is attached to the recording apparatus, the recording material storage section 2 and the ink sheet storage section 1 are constantly disunited from each other while the sections are constantly partially connected to each other. When the cassette is removed, the sections unite with each other. When the recording material storage section 2 and the ink sheet storage section 1 unite with each other, the ink sheet storage section functions as a lid or a pressing member of the recording material storage section, and is configured so as to protect the ink sheet in the ink sheet storage section. When the consumable cassette is attached to the recording apparatus, the recording material storage section and the ink sheet storage section are disunited from each other. The ink sheet storage section is recordably disposed in the recording apparatus, and the recording material storage section is opened in a position where the recording material can be supplied to a recording position in the recording apparatus.

Here, an effective means for separating the recording material storage section and the ink sheet storage section from each other is a sliding movement of the consumable cassette on an inclined surface disposed on, for example, a side surface of the recording apparatus. Two parallel planes come into contact with each other at a certain or more angle in a state in which the planes are not parallel to each other or do not cross each other at right angles. In this case, slippage is generated on the surfaces, and the surfaces slide on each other. When this sliding movement is performed, at least one component is moved. Especially, a rotatable member rotates, and a slidable member slides. When this sliding surface is disposed on the side surface of the recording apparatus, the movable member brought into contact with this sliding surface moves, and is guided to an appropriate position.

Moreover, an effective uniting means is urging performed by an elastic member such as a torsion spring or a coil spring. When the component is urged beforehand by the elastic member, the slid component undergoes a reactive force of the elastic member and tries to return to an original position. Therefore, when the cassette is discharged, the sliding surface brought into contact with the component leaves the component. Moreover, the surface can shift to a state before the cassette is loaded.

When the sliding surface and the urging performed by the elastic member are utilized in this manner, an operation to be performed by a user can be minimized. A handling property of the consumable can further be improved.

It is to be noted that, when the consumable cassette 10 is attached to the recording apparatus, at least one of components constituting the recording apparatus, such as the supply unit (supply roller) 56, the platen roller 63, the conveyance mechanism and the recording head 62, is disposed in the space 65 formed in this consumable cassette. The conveyance mechanism conveys, to the image recording section 60, the recording material sent by the supply roller. The mechanism includes, for example, a conveyance roller and a conveyance guide member. Furthermore, a state in which the recording material and the ink sheet are stored in the consumable cassette is substantially the same as that in a well known cassette. For the sake of simplicity, the stored ink sheet and recording material are omitted from the drawings illustrating the embodiment. The recording material storage section and the ink sheet storage section are disunited from each other by a user's operation and guidance of the guide member. The sections are united with each other by the user's operation and the urging force of the torsion spring. However, specific structures of such disuniting and uniting units are omitted from the drawings.

Second Embodiment

Figure 4A:
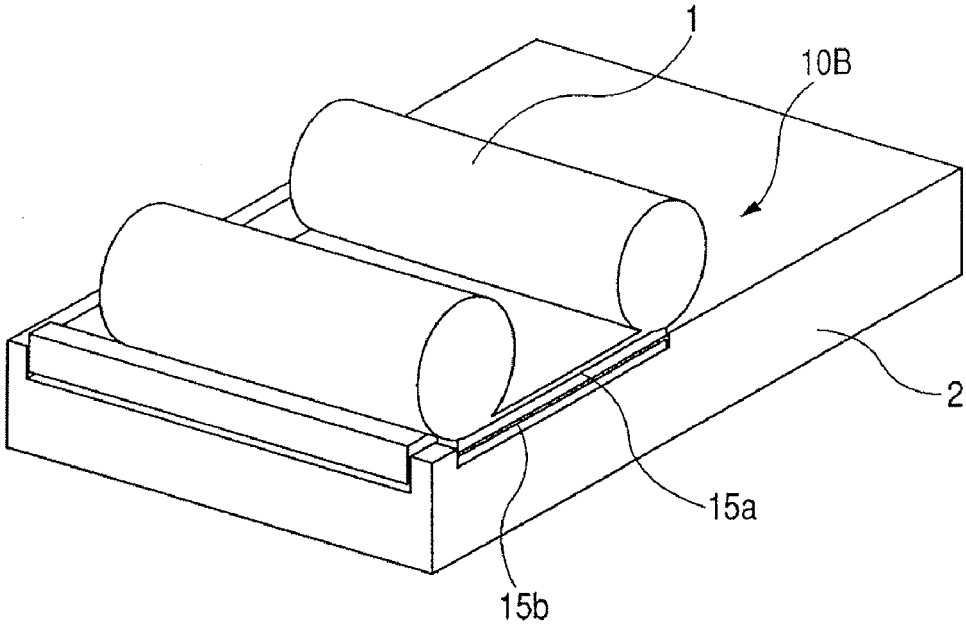
FIGS. 4A and 4B are perspective views schematically illustrating a second embodiment of the consumable cassette according to the present invention.
Figure 4B:
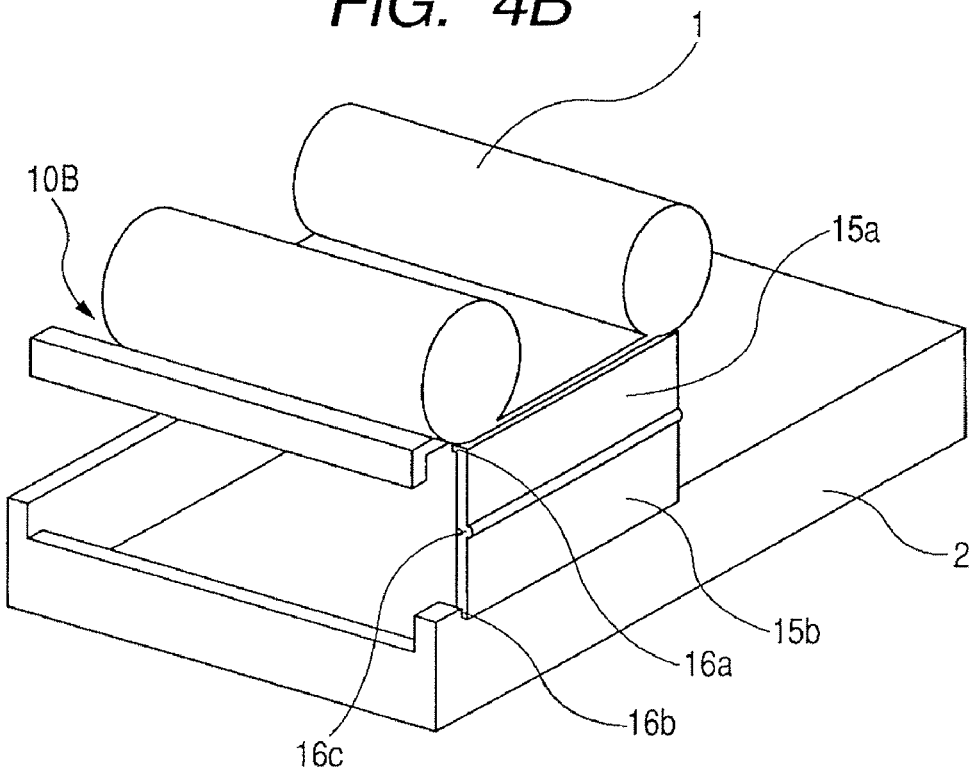

FIGS. 4A and 4B are perspective views of the second embodiment of a consumable cassette according to the present invention, FIG. 4A illustrates that the cassette is removed from a recording apparatus, and FIG. 4B illustrates that the cassette is disposed in the recording apparatus. In a consumable cassette 10B of the present embodiment of FIGS. 4A and 4B, an ink sheet storage section 1 is connected to a recording material storage section 2 so that the sections can be disunited from or united with each other via two rotary members 15*a*, 15*b*. One rotary member 15*a* is connected to one side end portion of the ink sheet storage section 1 via a rotary shaft portion 16*a*, and the other rotary member 15*b* is connected to one side end portion of the recording material storage section 2 via a rotary shaft portion 16*b*. Moreover, both of the rotary members 15*a*, 15*b* are foldably connected to each other via a rotary shaft portion 16*c* disposed between the rotary members.

In this case, each of the rotary shaft portions 16*a*, 16*b* arranged in two storage sections is deformable in an angle range of 0 degree to 90 degrees. The intermediate rotary shaft portion 16*c* is deformable in an angle range of 0 degree to 180 degrees. Therefore, in a state in which the consumable cassette is removed from the recording apparatus, as shown in FIG. 4A, two rotary members 15*a*, 15*b* are folded and stored in the consumable cassette 10B. When the consumable cassette 10B is attached to the recording apparatus, the rotary members are brought into a disunited state by a guide member of the recording apparatus as shown in FIG. 4B. In this state, between the ink sheet storage section and the recording material storage section, a space 65 is secured so as to arrange components constituting the recording apparatus such as a supply roller 56, a platen roller 63 and a conveyance unit.

Moreover, at least two of the three rotary shaft portions 16*a*, 16*b* and 16*c* are provided with torsion springs, and urged by the springs so that the sections shift to a united state of FIG. 4A immediately after the cassette is removed from the recording apparatus. Even according to the present embodiment, an effect similar to that of the above first embodiment is obtained. Furthermore, according to the present embodiment, when the rotary members 15*a*, 15*b* are lengthened, it is possible to secure a large space for arranging the components (the supply roller and the conveyance mechanism) constituting the recording apparatus without increasing an apparatus size.

Third Embodiment

Figure 5A:
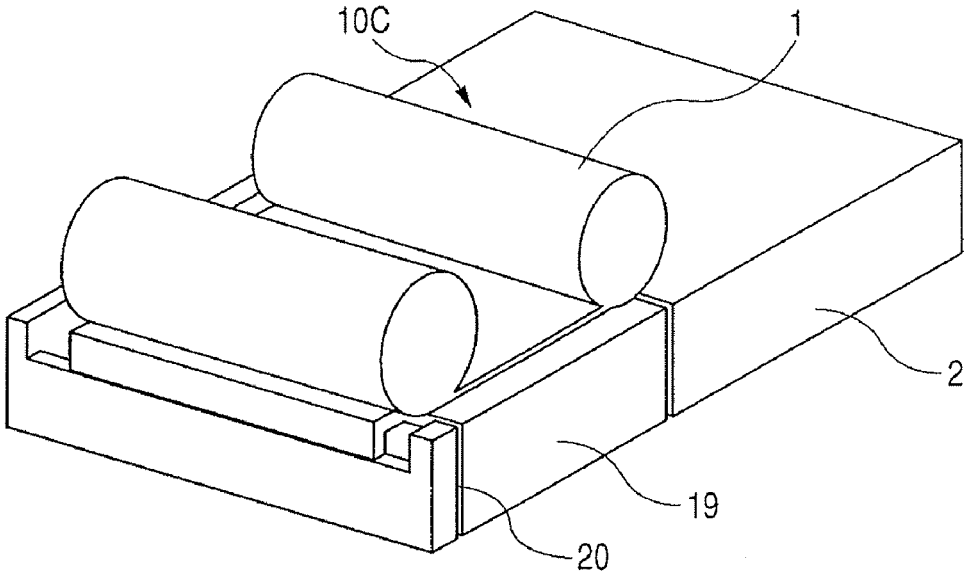
FIGS. 5A and 5B are perspective views schematically illustrating a third embodiment of the consumable cassette according to the present invention.
Figure 5B:
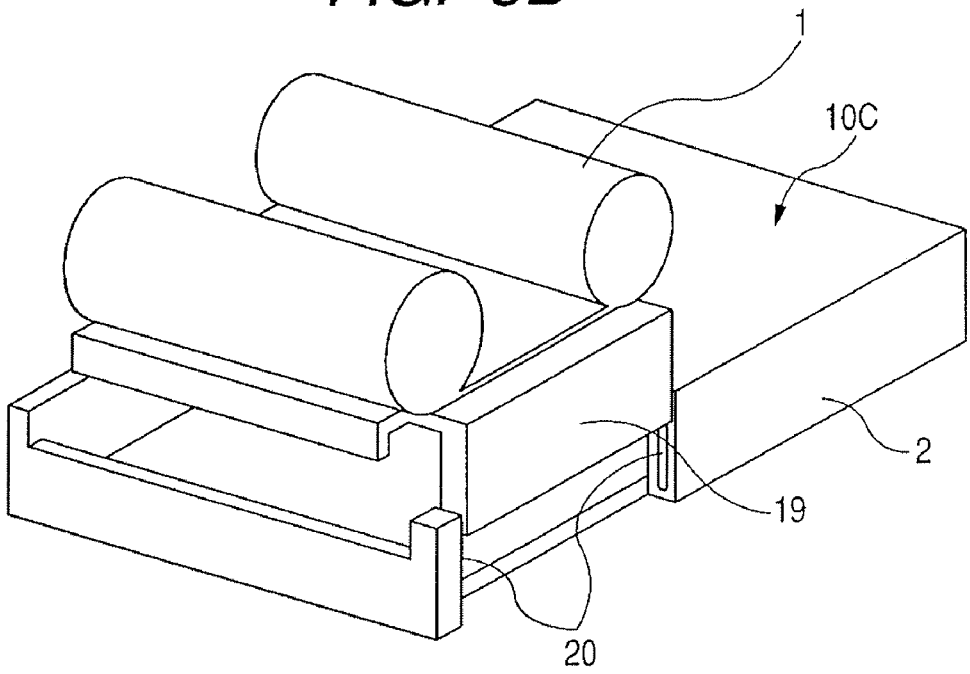

FIGS. 5A and 5B are perspective views of the third embodiment of a consumable cassette according to the present invention, FIG. 5A illustrates that the cassette is removed from a recording apparatus, and FIG. 5B illustrates that the cassette is disposed in the recording apparatus. In a consumable cassette 10C of the present embodiment, an ink sheet storage section 1 is connected to a recording material storage section 2 via a slide member 19 so that the sections can disunite from or unite with each other. The slide member 19 is connected to one side end portion of the ink sheet storage section 1, and is movable along a guide groove 20 formed in the recording material storage section 2 in a vertical direction. That is, the ink sheet storage section 1 is moved by the slide member 19 in a height direction (a direction of front and back surfaces of a recording material) toward the recording material storage section 2 so that the sections can disunite from or unite with each other. Even in the present embodiment, when the consumable cassette 10C is attached to the recording apparatus, the sections are brought into a disunited state shown in FIG. 5B by a regulating portion in the recording apparatus. In this state, between the ink sheet storage section and the recording material storage section, a space 65 is secured so as to store constituting components such as a supply roller and a conveyance mechanism of the recording apparatus.

In the present embodiment, the slide direction is substantially parallel to the height direction of the recording material storage section 2. An urging unit is disposed between the recording material storage section and the ink sheet storage section so as to shift the slide member 19 from the disunited state of FIG. 5B to a united state of FIG. 5A, when the cassette is removed from the recording apparatus. This urging unit includes, for example, a spring urging unit such as a coil spring and an elastic member such as rubber. Even according to the fifth embodiment, an effect similar to the effects of the first and second embodiments is obtained.

Fourth Embodiment

Figure 6A:
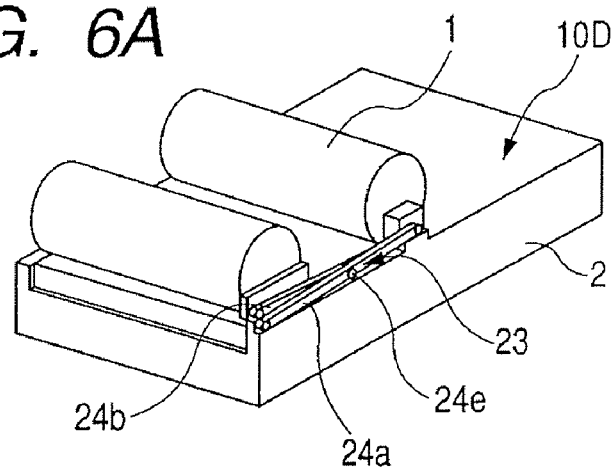
FIGS. 6A, 6B and 6C are perspective views schematically illustrating a fourth embodiment of the consumable cassette according to the present invention.
Figure 6B:
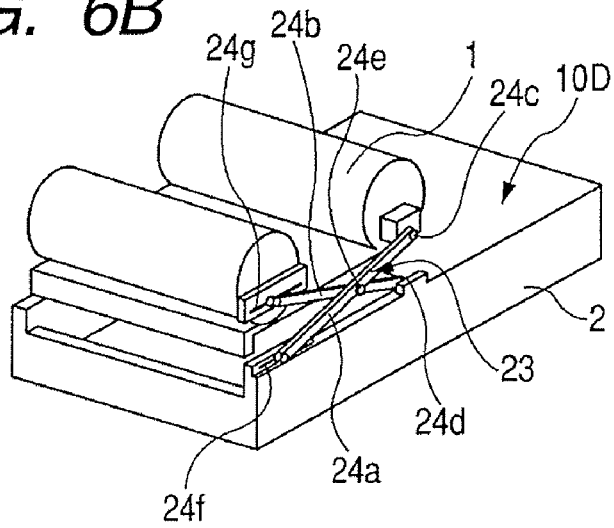
Figure 6C:
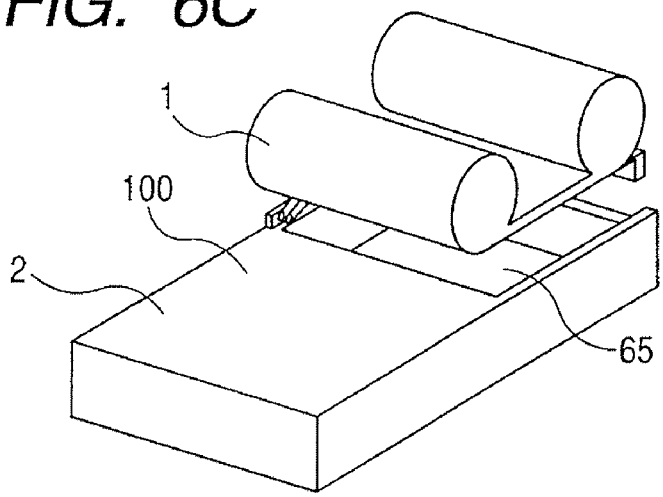

FIGS. 6A, 6B and 6C are perspective views of the fourth embodiment of a consumable cassette according to the present invention, FIG. 6A illustrates that the cassette is removed from a recording apparatus, FIG. 6B is illustrates that the cassette is disposed in the recording apparatus, and FIG. 6C is a perspective view from which the recording apparatus is omitted and which illustrates a state as viewed from a direction reverse to that of FIG. 6B. In a consumable cassette 10D of the present embodiment, an ink sheet storage section 1 is connected to a recording material storage section 2 via a slide member (a slide mechanism) 23 so that the sections can disunite from or unite with each other. The slide mechanism 23 includes two link members 24*a*, 24*b*. One link member 24*a* is supported swingably centering on a support point 24*c* disposed on the ink sheet storage section 1. The other link member 24*b* is supported swingably centering on a support point 24*d* disposed on the recording material storage section 2. The link member 24*a* is connected to the link member 24*b* via a rotatable pin connecting portion 24*e* disposed at an intermediate portion between the link members.

Moreover, the link member 24*a* is supported on an ink sheet storage section side. A protruding pin portion of a distal end of the link member 24*a* is slidably engaged with a horizontal groove 24*f* of the recording material storage section. Furthermore, the link member 24*b* is supported on a recording material storage section side. A protruding pin portion of a distal end of the link member 24*b* is slidably engaged with a horizontal groove 24*g* of the ink sheet storage section. The ink sheet storage section 1 is connected to the recording material storage section 2 via the slide member 23 including such a link mechanism so that the ink sheet storage section is relatively displaceable in a height direction with respect to the recording material storage section. Even in the present embodiment, when the consumable cassette 10D is attached to the recording apparatus, the cassette is brought into a disunited state as shown in FIG. 6B by a guide portion in the recording apparatus. In consequence, a space 65 is secured between the ink sheet storage section and the recording material storage section.

Moreover, an urging unit is disposed between the recording material storage section and the ink sheet storage section so as to shift the slide member 23 from the disunited state of FIG. 6B to a united state of FIG. 6A, when the cassette is removed from the recording apparatus. This urging unit includes, for example, a spring urging unit such as a torsion spring or a coil spring and an elastic member such as rubber. Even according to the embodiment of FIGS. 6A to 6C, a function and an effect similar to those of the above embodiments are obtained.

As shown in FIG. 6C, when the consumable cassette is attached to the recording apparatus, an operation member of the cassette on an opposite side is brought into an open state so that a conveyance mechanism and a recording mechanism of the recording apparatus are inserted into a space portion of the consumable cassette.

Fifth Embodiment

Figure 7A:
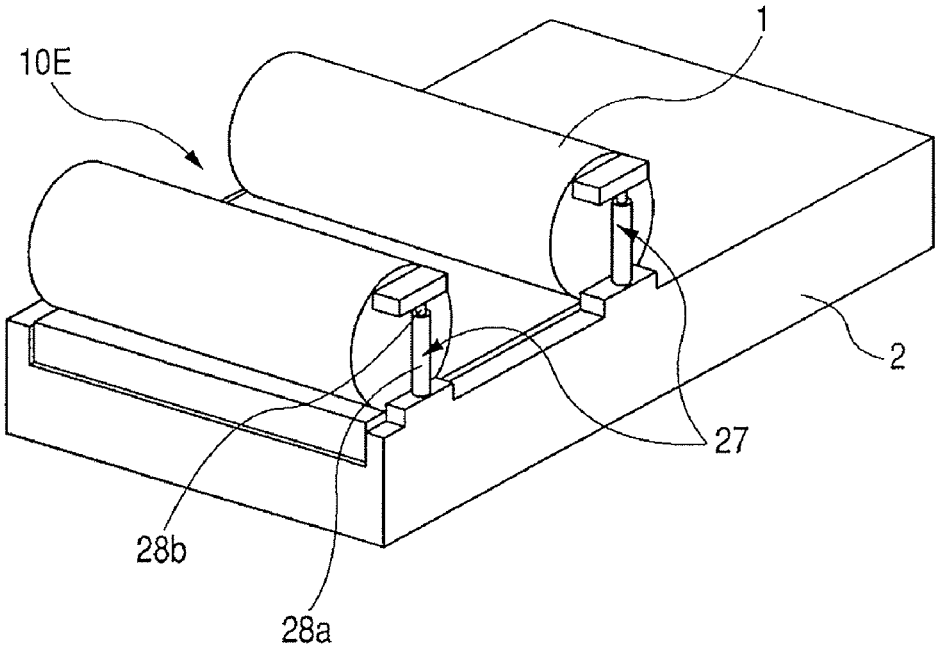
FIGS. 7A and 7B are perspective views schematically illustrating a fifth embodiment of the consumable cassette according to the present invention.
Figure 7B:
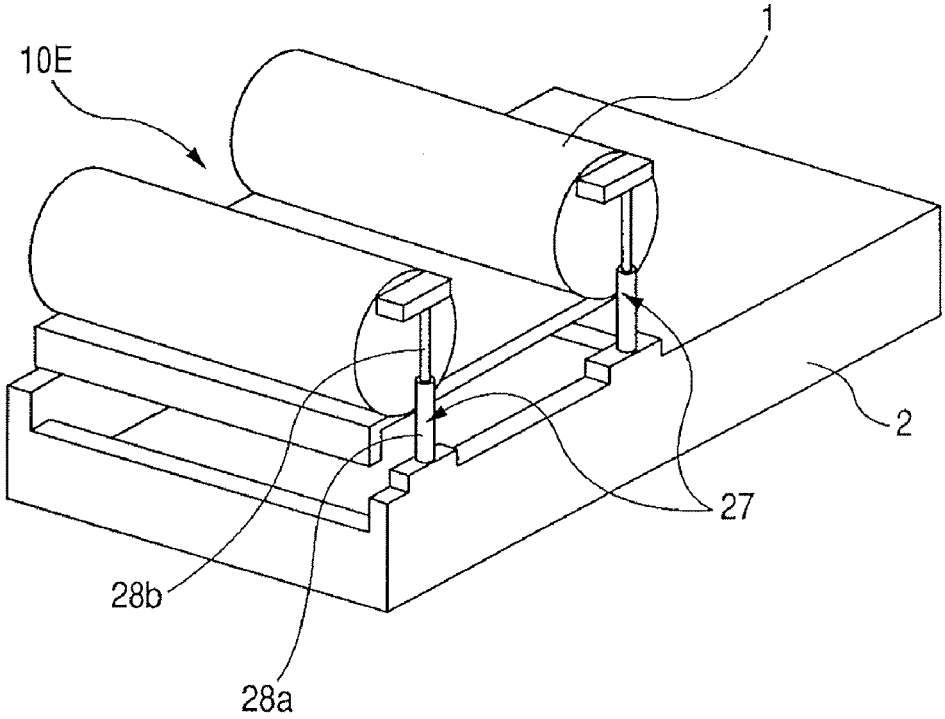

FIGS. 7A and 7B are perspective views of the fifth embodiment of a consumable cassette according to the present invention, FIG. 7A illustrates that the cassette is removed from a recording apparatus, and FIG. 7B illustrates that the cassette is disposed in the recording apparatus. In a consumable cassette 10E of the present embodiment, an ink sheet storage section 1 is connected to a recording material storage section 2 via expansion and contraction members (expansion and contraction components) 27 which are expandable/contractible in a height direction so that the sections can disunite from or unite with each other. Each of the expansion and contraction members 27 is constituted by, for example, fitting a bar-like member 28*b* into a cylindrical member 28*a*. The bar-like member is urged with a spring in a retracting direction. When the consumable cassette is attached to the recording apparatus, a force acts in such a direction to pull the bar-like member 28*b* from another portion. On the other hand, when the cassette is removed from the recording apparatus, the bar-like member 28*b* is quickly retracted, and returned to an original contracted state. The ink sheet storage section 1 is connected to the recording material storage section 2 via such expansion and contraction members 27 so that the sections can disunite from or unite with each other.

Even according to the present embodiment, when the consumable cassette 10E is attached to the recording apparatus, the sections are brought into a disunited state shown in FIG. 7B by a regulating portion in the recording apparatus. In this disunited state, between the ink sheet storage section and the recording material storage section, a space 65 is secured so as to store constituting components such as a supply roller and a conveyance mechanism of the recording apparatus. Moreover, when the cassette is removed from the recording apparatus, the expansion and contraction members 27 quickly contract. In consequence, the ink sheet storage section and the recording material storage section shift to a united state. Therefore, even according to the present embodiment, a function and effect similar to those of the above embodiments can be obtained.

Sixth Embodiment

Figure 8A:
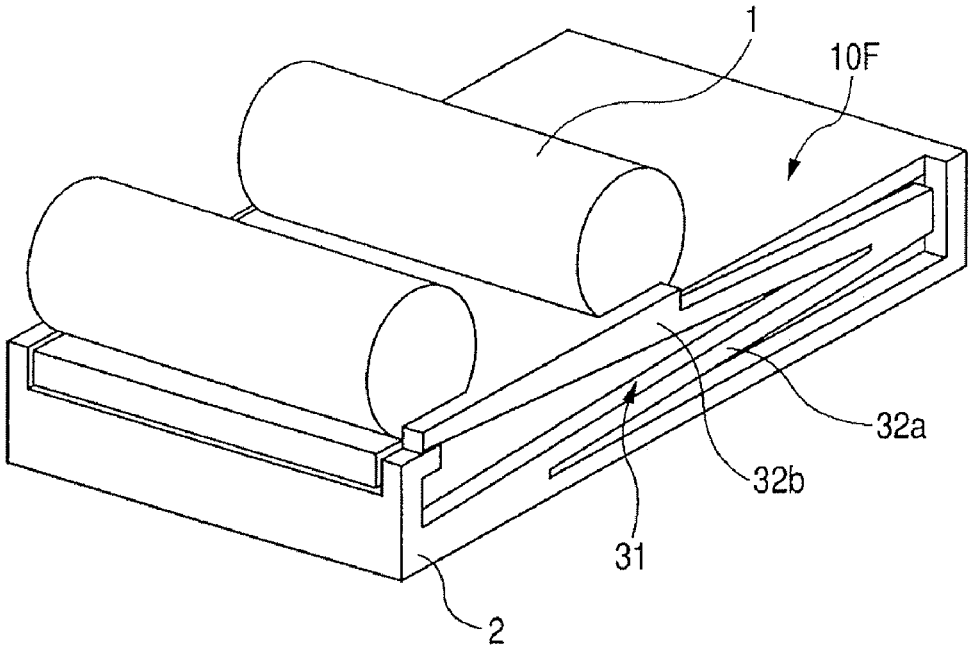
FIGS. 8A and 8B are perspective views schematically illustrating a sixth embodiment of the consumable cassette according to the present invention.
Figure 8B:
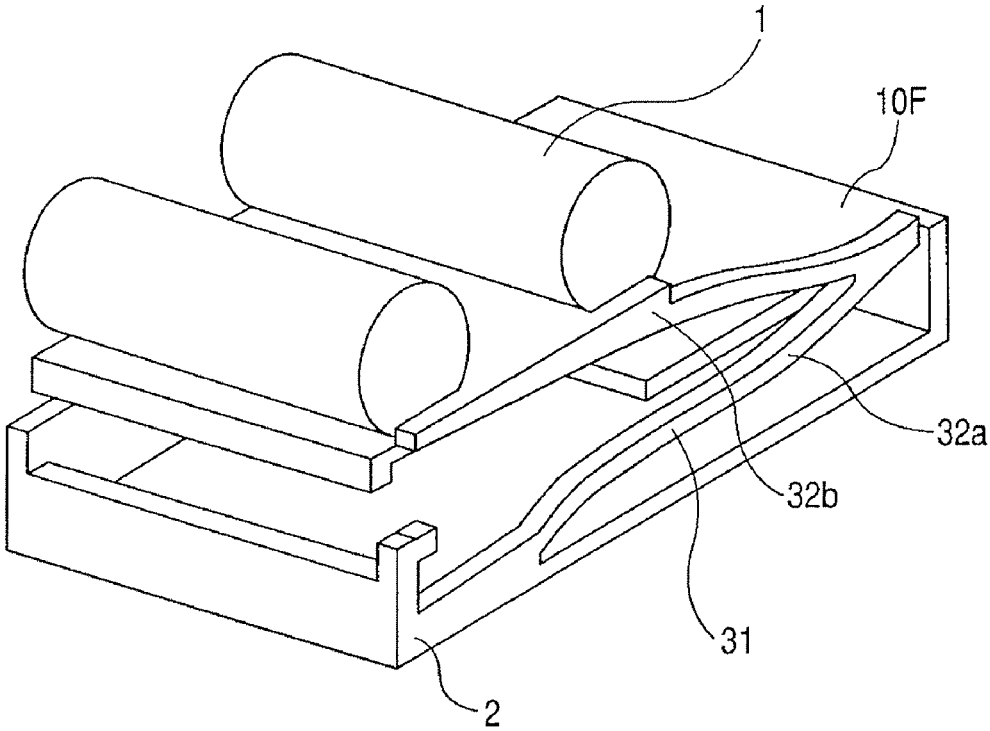

FIGS. 8A and 8B are perspective views of the sixth embodiment of a consumable cassette according to the present invention, FIG. 8A illustrates that the cassette is removed from a recording apparatus, and FIG. 8B illustrates that the cassette is disposed in the recording apparatus. In a consumable cassette 10F of the present embodiment, an ink sheet storage section 1 is connected to a recording material storage section 2 via an elastically deformable elastic member 31 so that the sections can disunite from or unite with each other. The elastic member 31 of the present embodiment is formed integrally with the recording material storage section 2, and includes a lower arm portion 32*a* and an upper arm portion 32*b* extending from one end of the lower arm portion. Moreover, one side end portion of the ink sheet storage section 1 is connected (secured) to an upper surface of the upper arm portion 32*b*.

When any external force does not function, the elastic member 31 has a low posture (a thin construction). Therefore, when the cassette is removed from the recording apparatus, as shown in FIG. 8A, the ink sheet storage section 1 comes close to the recording material storage section to unite with the section. On the other hand, when the consumable cassette 10F is attached to the recording apparatus, the upper arm portion 32*b* is lifted upwards by a guide portion in the recording apparatus. In consequence, the ink sheet storage section disunites from the recording material storage section to secure a space 65 between the sections in which a supply roller 56 of the recording apparatus is disposed. When the consumable cassette 10F is removed from the recording apparatus, the elastic member 31 quickly restores an original flat state. As shown in FIG. 8A, the cassette is brought into a compact united state.

According to the above embodiments, the consumable cassette is provided in which the recording material and the ink sheet as consumables can detachably attached to the recording apparatus from one direction. When the cassette is removed from the recording apparatus, management is facilitated and a space is saved. The consumable cassette of the recording material and the ink sheet is provided which advantageously contributes to miniaturization of the recording apparatus while keeping a satisfactory balance between an installation area and a height direction. Furthermore, the consumable cassette is provided which has an excellent handling property to such an extent that the cassette can quickly and securely attached to or removed from the recording apparatus by one operation. In addition, the consumable cassette is provided which has an excellent storing property to such an extent that any dirt or crack is not easily generated on the recording material and the ink sheet, regardless of whether the cassette is brought into an attached state or a stored state.

It is to be noted that according to the embodiment described with reference to FIGS. 8A and 8B, a cassette case can integrally be molded of a single material, steps of assembling the cassette can be minimized, and the provided consumable cassette also has an excellent productivity. In a case where the recording material is discarded because the material has been used up, the ink sheet and supply and windup units (rolls, etc.) of the ink sheet are removed. In consequence, the constituting materials can easily be sorted as compared with another cassette. Therefore, during recovery for a purpose of reuse such as recycle, a disassembling step can remarkably be simplified. Furthermore, according to the above embodiments, in the cassette of the consumables which would generally be consumed in a large amount, a construction can be realized in which material and assembly costs of the consumable cassette can be reduced and in which an environmental problem is considered.

It is to be noted that in the above embodiments, application of the present invention to the thermal transfer recording apparatus has been described, but the present invention is similarly applicable even to another recording type of recording apparatus as long as two types of consumables, that is, the recording material and the ink sheet are used in the recording apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2006-040626, filed Feb. 17, 2006 and 2007-013396, filed Jan. 24, 2007, which are hereby incorporated by reference herein in their entirety.

What is claimed is:

1. A consumable cassette that is attachable to and detachable from a recording apparatus, the cassette comprising:

a recording material storage section to store a recording material;

an ink sheet storage section to store an ink sheet; and an operation structure to connect the recording material storage section to the ink sheet storage section and to displace the recording material storage section and the ink sheet storage section in a direction in which the sections come away from each other and a direction in which the sections come close to each other.

2. The consumable cassette according to claim 1, wherein when the consumable cassette is attached to the recording apparatus, the recording material storage section disunites from the ink sheet storage section; and when the consumable cassette is removed from the recording apparatus, the recording material storage section comes close to the ink sheet storage section to unite with the ink sheet storage section.

3. A consumable cassette according to claim 1, wherein the ink sheet storage section is disposed above the recording material storage section via a space in a state in which the recording material storage section is disposed downwards in a gravity direction.

4. A consumable cassette according to claim 1, wherein the recording material is conveyed from the consumable cassette by switchback.

5. A consumable cassette according to claim 1, wherein the operation structure urges the ink sheet storage section with an urging force in such a direction that the ink sheet storage section comes close to the recording material storage section to unite with the recording material storage section, shifts to a united state when the consumable cassette is removed from the recording apparatus, and shifts to a disunited state against the urging force when the consumable cassette is attached to the recording apparatus.

6. A consumable cassette according to claim 1, wherein when the consumable cassette is removed from the recording apparatus, the operation structure urges the ink sheet storage section so as to regulate movement of the recording material of the recording material storage section, and urges the recording material storage section to protect the ink sheet of the ink sheet storage section.

7. A consumable cassette according to claim 1, wherein when the recording material storage section is united with the ink sheet storage section, the ink sheet storage section functions as a lid or a pressing member of the recording material storage section so as to protect the ink sheet of the ink sheet storage section.

8. A consumable cassette according to claim 1, wherein when the consumable cassette is attached to the recording apparatus, the recording material storage section is disunited from the ink sheet storage section, the ink sheet storage section is recordably disposed in the recording apparatus, and the recording material storage section is opened in a position where the recording material is supplied to a recording position of the recording apparatus.

9. A consumable cassette according to claim 1, wherein the operation structure is a rotary member which rotatably connects the recording material storage section to the ink sheet storage section.

10. A consumable cassette according to claim 1, wherein the operation structure is a slide member which slidably connects the recording material storage section to the ink sheet storage section.

11. A consumable cassette according to claim 1, wherein the operation structure is an expansion and contraction member which expandably/contractibly connects the recording material storage section to the ink sheet storage section.

12. A consumable cassette according to claim 1, wherein the operation structure is an elastic member which elastically displaceably connects the recording material storage section to the ink sheet storage section.

13. A recording apparatus comprising:

a loading section to which a consumable cassette is to be loaded, the consumable cassette comprising a recording material storage section to store a recording material and an ink sheet storage section to store an ink sheet;

a recording mechanism including a recording material conveyance mechanism which operates the recording material storage section, an ink sheet conveyance mechanism which operates the ink sheet storage section and a recording head; and an operation structure to connect the recording material storage section to the ink sheet storage section and to displace the recording material storage section and the ink sheet storage section in a direction in which the sections come away from each other and a direction in which the sections come close to each other.

14. A recording apparatus according to claim 13, wherein the recording head is a thermal head by which ink is melted and transferred from the ink sheet to the recording material to record an image.

* * * * *

UNITED STATES PATENT AND TRADEMARK OFFICE

CERTIFICATE OF CORRECTION

PATENT NO. : 7,425,974 B2
APPLICATION NO. : 11/673211
DATED : September 16, 2008
INVENTOR(S) : Ogawa It is certified that error appears in the above-identified patent and that said Letters Patent is hereby corrected as shown below:

COLUMN 3:
Line 31, “handing” should read --handling--.

COLUMN 5:
Line 22, “Further” should read --Further,--.

COLUMN 9:
Line 16, “crack” should read --cracks--.

COLUMN 11:
Line 60, “fifth” should read --third--.

COLUMN 13:
Line 63, “can” should read --can be--.

COLUMN 14:
Line 50, “securely” should read --securely be--.

Signed and Sealed this

Third Day of March, 2009

JOHN DOLL
*Acting Director of the United States Patent and Trademark Office*